United States Patent [19]

Lesser et al.

[11] 3,948,555

[45] Apr. 6, 1976

[54] GLIDER

[75] Inventors: Bertram Lesser, Mamaroneck, N.Y.; Frank J. Hart, Fair Lawn, N.J.

[73] Assignee: Duralite Company, Inc., Passaic, N.J.

[22] Filed: Aug. 14, 1974

[21] Appl. No.: 497,201

[52] U.S. Cl. ..... 297/39; 248/430; 297/344

[51] Int. Cl.[2] ..... A47C 1/00

[58] Field of Search ..... 297/344, 32, 33, 16, 39; 248/430

[56] References Cited

UNITED STATES PATENTS

| | | | |
|---|---|---|---|
| 136,099 | 2/1873 | Russell | 297/32 X |
| 1,782,763 | 11/1930 | Overbey | 297/32 X |
| 2,543,543 | 2/1951 | Gomes et al. | 297/32 X |
| 3,098,678 | 7/1963 | Pearlstine | 297/344 |
| 3,114,572 | 12/1963 | Hopkins | 297/33 |
| 3,170,666 | 2/1965 | Reiter et al. | 297/344 X |

FOREIGN PATENTS OR APPLICATIONS

| | | | |
|---|---|---|---|
| 195,025 | 3/1965 | Sweden | 297/32 |

*Primary Examiner*—Roy D. Frazier
*Assistant Examiner*—Darrell Marquette
*Attorney, Agent, or Firm*—Lerner, David, Littenberg & Samuel

[57] ABSTRACT

A glider is provided which is designed for easy assembly and which may be easily collapsed for storage purposes. The glider includes a frame having a seat and back rest, and a pair of side members, each of which includes an arm rest or head rest portion, which side members are mounted on each end of the frame. An elongated roller support member is provided for each end of the frame and includes an upper track member and a lower track member, the upper track member including a substantially flat top wall and a pair of spaced substantially flat side walls extending from and connected at substantially right angles to the top wall. At least two wheels are rotatably mounted to and between the side walls of each of the upper track members. The lower track member includes a track portion substantially U-shape in cross-section and adapted to receive the wheels, and a floor engaging member. The side legs of the U-shaped track portion extend upwardly along the sides of the wheels to assist in preventing the wheels from being disengaged from the track portion. The frame further includes biasing means extending between the side members of the frame and the lower track members for yieldingly urging the wheels in contact relation with the track portions. In a preferred embodiment, the side members will include first and second strut members, the first strut member being adapted to be received by a first opening in the top wall of the upper track member and pivotally secured to the side walls thereof. The second strut member is adapted to be recieved by a second opening in the top wall and is supported therein by support means, such as in the form of a pin which is mounted to and between the side walls of the upper track member. Thus, the second strut members of the side members of the frame are adapted to be lifted from the top wall of each of the upper track members, without the need for first removing any bolts or screws, to facilitate collapsing of the glider for storage purposes.

12 Claims, 6 Drawing Figures

FIG. 4
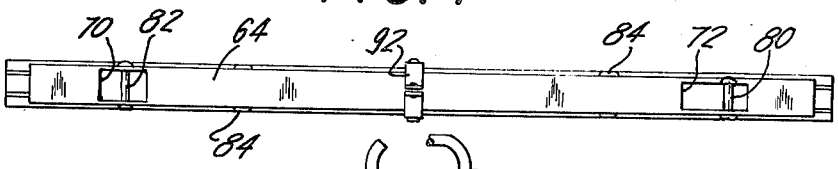
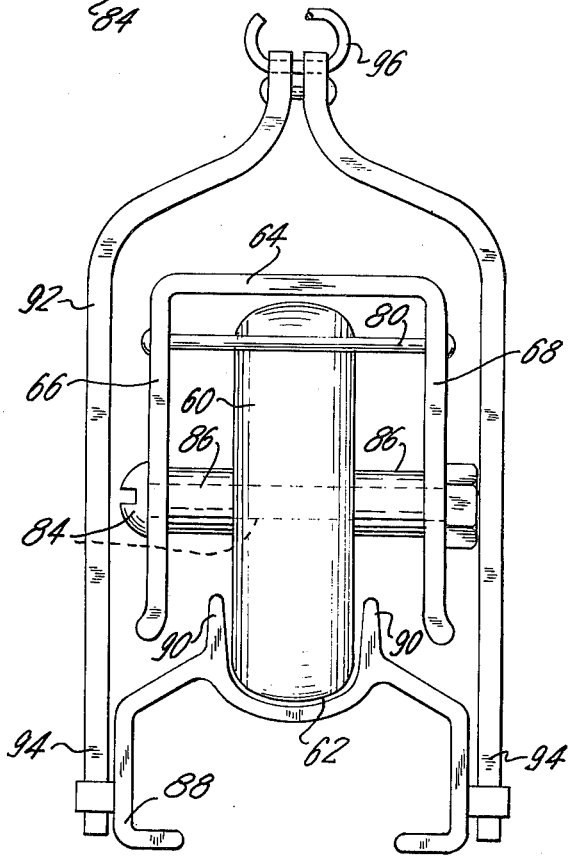
FIG. 5
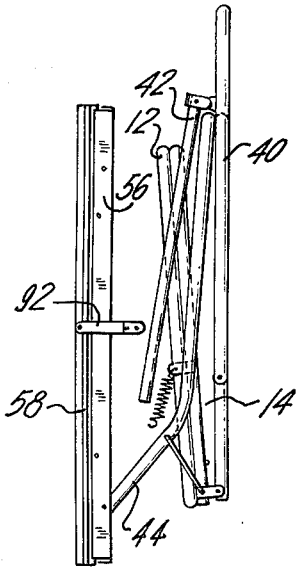
FIG. 6

GLIDER

FIELD OF THE INVENTION

The present invention relates to sitting furniture of the type known as gliders and more particularly relates to a glider which is easily collapsed for storage purposes.

BACKGROUND OF THE INVENTION

Glider furniture wherein the occupant of the glider controls the generally forward and backward oscillating gliding motion is well known in the art. For example, Reissue Pat. No. 25,239 and U.S. Pat. Nos. 3,046,053 and 3,098,678 discloses gliders which include a frame supported by a pair of horizontally extending parallel tracks spaced vertically one above the other and separated by a pair of intervening ball bearings. U.S. Pat. No. 3,170,666 discloses a glider construction, which is slightly different from those disclosed in the aforementioned patents, wherein a pair of spaced apart wheels are employed in place of ball bearings. However, all of the various glider constructions in these patents employ biasing means which includes a yoke which extends over the pair of horizontally extending parallel tracks. A lower end of each yoke is pivotally secured to a mid-portion of the lower track of the pair and a spring is secured at one end to the upper end of the yoke and at the other end to a portion of the frame of the glider. When in place, as described, the spring is under substantial tension thereby yieldingly urging the rollers, whether they be ball bearings or wheels, in contact relation with the tracks.

As seen from the Figures of each of the above-mentioned patents, the gliders there disclosed are basically designed for permanent assembly. This is apparent from the fact that each of the side frame members of the various glider constructions are in the form of a continuous piece of tubing or rectangular design, the straight bottom leg of which is designed to be permanently secured to the upper track member of the pair of track members. Accordingly, in order to disassemble these gliders, it is first necessary to remove at least a pair of screws or bolts in order to release the sides or end frame members from the track members. It is virtually impossible to disconnect the spring from the yoke unless such screws or bolts have been removed and the track members are moved out of alignment with the bottom portion of the rectangular tubular side member so as to eliminate the tension in the spring. This is a cumbersome procedure and accordingly, the gliders of these patents are not designed for easy disassembly or for collapsing or folding or purposes of storage.

BRIEF STATEMENT OF THE INVENTION

In accordance with the present invention, a glider construction is provided which is adapted for easy disassembly and/or collapsing for purposes of storage. In one embodiment of the glider of the present invention, the glider is in collapsible form and may be simply and easily collapsed without the necessity of removing screws, bolt members or other fixing means.

The glider of the present invention which is designed for easy disassembly, and preferably is collapsible, includes a frame having first and second ends, the frame including a seat portion, a back rest portion and a pair of substantially vertically disposed side members mounted on each of the ends of the frame. The side members will include an arm rest or headrest portion. A pair of elongated roller support members are connected at either end of the frame and function as a gliding apparatus which oscillates back and forth without any sideways or twisting action of the glider. The roller support members each include an upper track member and a lower track member, the upper track member including a substantially horizontally disposed top wall and a pair of substantially vertically disposed spaced apart side walls connected to and extending downwardly from the top wall. Securing means are provided on the upper track member for pivotally securing a first portion of each of the side members to the upper track members, and support means are provided in the upper track members for supporting a second portion of each of the side members. At least two rollers are rotatably mounted to and between the side walls of each of the upper track members. The lower track members which are adapted to be disposed below the upper track members each includes a track portion adapted to receive the rollers, and a floor engaging member. The track portion of the lower track members are preferably of U-shape in cross section so that the rollers will be engaged in said track portion and the side legs thereof extend upwardly along the sides of the rollers to assist in preventing said rollers from being disengaged from said track portions. The frame also includes biasing means extending between the side members of the frame and the lower track members for yieldingly urging the rollers in contact relation with the track portions of the lower track members.

In a preferred embodiment of the invention, portions of the side members of the frame may be removed from the upper track members, without the necessity of first removing any screws or bolts, to faciliate collapsing of the glider for storage purpoes.

In addition, in accordance with the present invention, a roller support member or gliding apparatus as described above is provided for use in the glider of the invention.

The glider of the invention is of simple inexpensive construction and employs extruded members where possible. Furthermore, the glider automatically returns to its normal rest position whenever the glider is not in use or its occupant does not urge it to oscillate back and forth.

In a preferred embodiment of the invention, the glider is designed to be substantially completely collapsible as will be described hereinafter so that it may be stored while taking up a minimum of space.

BRIEF DESCRIPTION OF THE FIGURES

FIG. 4 is a plan view of the upper track member employed in the glider of the invention;

FIG. 5 is a fragmentary end view of the glider apparatus shown in FIG. 1; and FIG. 6 is a side elevation of the glider of FIG. 1 in collapsed form.

DETAILED DESCRIPTION OF PREFERRED EMBODIMENTS OF THE INVENTION

Figure 1:
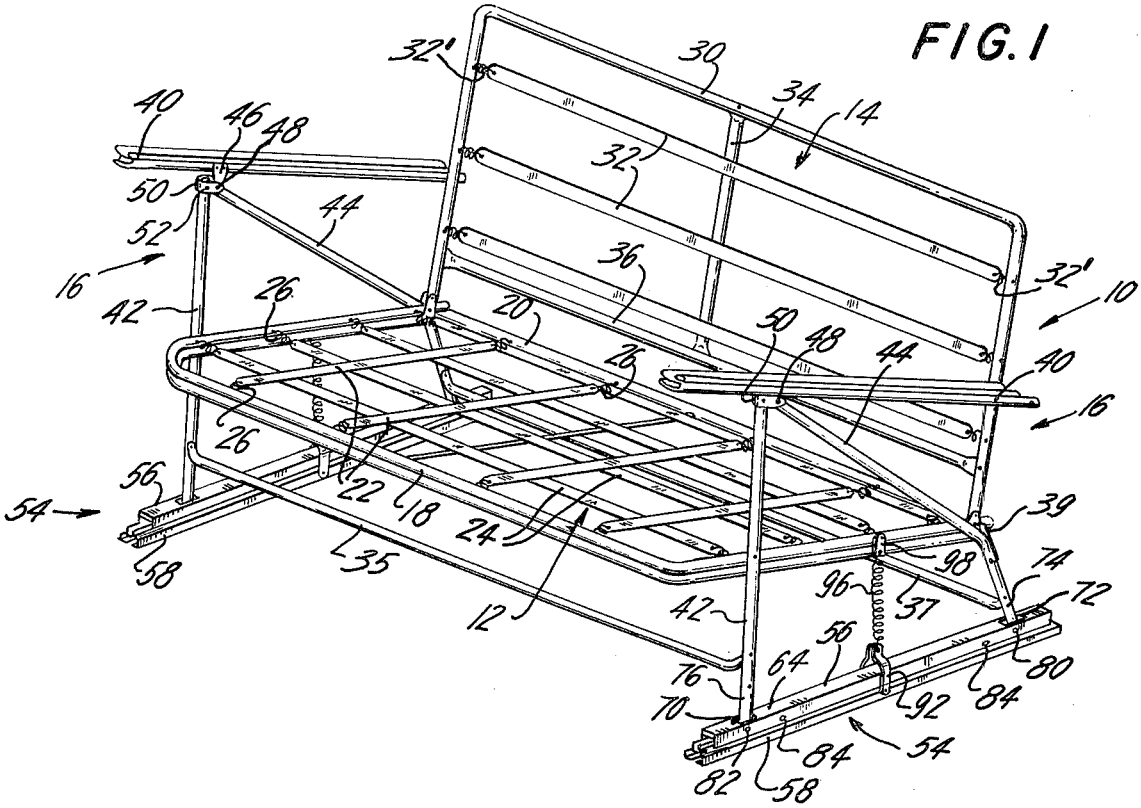
FIG. 1 is a perspective view of a glider in accordance with the present invention.

Referring now to the accompanying Figures wherein like numerals represent similar parts in the several views, the glider of the invention is generally designated by the numeral 10 and includes a seat portion 12, a back rest portion or member 14 and side members generally indicated by the numeral 16. The seat portion 12 includes a generally tubular U-shaped member 18, preferably a pair of such members for added support, secured to tubular support member 20. A plurality of support members in the form of cross struts 22 and 24 are connected to springs 26 which are in turn connected to tubular members 18 and 20, as shown, to provide resilient support. The back rest member includes a generally U-shaped tubular member 30 which is pivotally secured at each end to corresponding ends of the tubular members forming the seat portion as shown. Support members 32 are connected to the tubular member through springs 32', as shown, to provide a resilient back support. Furthermore, support members 34 and 36 are connected to each other and to the tubular member 30 to impart durability to the back rest member.

The side members 16 each comprise an armrest portion 40 which, as shown, preferably comprises a tubular member fashioned to form a U-shape, with the ends of the tubular member being pivotally secured to the tubular member 30 of the back rest portion 14 as shown. A first strut member 42 and a second strut member 44 are pivotally connected to each of the armrest portions 40. The strut members 42 are also connected by means of bolts or screws to tubular member 18 of the seat portion 12.

Front cross member 35 is secured to each of the strut members 42 and 44, as shown in FIG. 1, and a back cross strut or support member 37, as shown in FIG. 1, is connected to the strut members 44 to provide additonal support for such members. A support bar 39, best shown in FIGS. 2 and 3, connects each of the strut members 44 to the tubular member 30 or 18 to provide still additional support.

In a preferred embodiment of the invention, each of the armrest portions 40 includes a first bracket 46. A pivot pin 48 is connected to the first bracket 46 and pivotally connects an upper end of the strut member 44 to the bracket 46 and also pivotally connects a second bracket 50 to the bracket 46. The strut member 42 is pivotally connected to the second bracket 50 by means of pivot pin 52.

Figure 2:
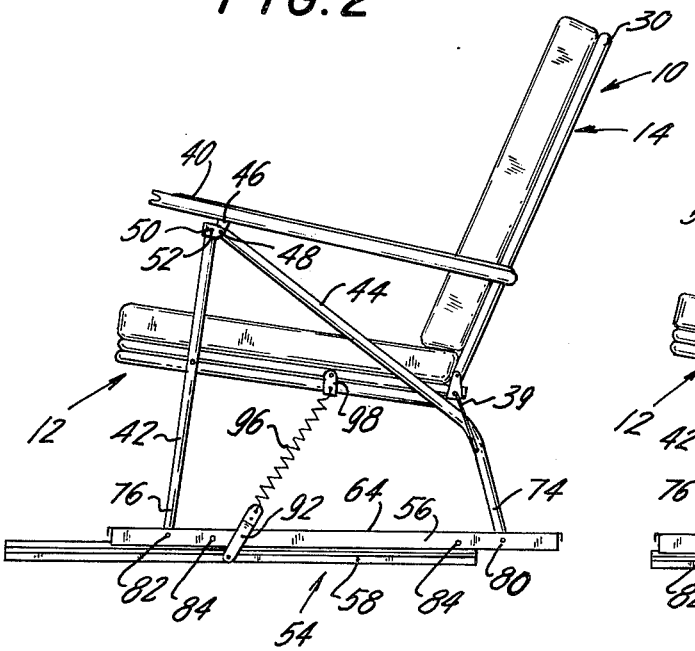
FIG. 2 is a side elevation of the glider shown in FIG. 1 illustrating the seat in rearward displaced position.

The side members 16 are supported by gliding apparatus 54 which comprises a pair of roller support members, each of which includes an upper track member 56 and a lower track member 58 as shown in FIG. 5. The track memers 56 and 58 generally comprise one piece extruded members preferably formed of aluminum or corrosion resistant steel. In general, the upper track members 56 support the side members 16 and wheels or rollers 60 (to be described in detail hereinafter) and the lower track members 58 each includes track 62 for the wheels or rollers 60. The upper track members 56 generally include a substantially flat top wall 64 and a pair of spaced apart generally flat side walls 66 and 68 which are connected to the top wall 64 and extend downwardly therefrom as shown. It is best seen in FIG. 4 that the top walls 64 each include a first opening 70 and a second opening 72. As shown in FIGS. 1 and 2, the openings 72 at the top wall 64 are each adapted to receive one end 74 of the strut members 44 while the openings 70 are each adapted to receive one end 76 of the strut members 42. The end 74 of each of the strut members passes through the opening 72 and is pivotally secured to the side walls 66 and 68 by means of pivot pin 80. Support means such as pin 82, is disposed below the opening 70 in each of the top walls 64 and serves to support the end of each of the strut members 42. A pair of bolts or pins 84 (only one of which is shown in FIG. 5) is fastened to and between the side walls 66 and 68. Rotatably mounted on the mid-portion of each of the pins 84 is wheel or roller 60 on each side of which is a spacer 86 for maintaining the wheel or roller 60 on its proper position on the pin 84. The wheel or roller 60 rides on the track 62 which is connected to floor engaging means 88. In the preferred embodiment of the invention, the track 62 and the floor engaging means 88 are of one piece construction, as shown. The track 62 is provided with upwardly extending side flanges 90 to serve as guide means for the roller or wheel 60 and for preventing any foreign matter from interfering with the proper operation of the wheel or roller on the track 62.

In order to cause the upper track members 56 to oscillate on the lower track members 58 in a symmetrical manner and to resume its normal mid-position on the lower track member 58 when not swinging or sliding thereon, there is provided a yoke 92 pivotally secured at its lower end 94 to the middle of each floor engaging member 88 as shown. The upper end of each of the yokes 92 is secured to one end of a coil spring 96 whose other end extends to a bracket 98 which is secured to the side legs of the U-shaped tubular member forming a portion of the seat portion 12 of the glider. The bracket 98 is secured preferably to the mid-portion of each of the legs of the U-shaped tubular member 18 forming the outer periphery of the seat portion.

Operation of the glider of the invention in its assembled form as shown in the FIGS. 1 and 2 will be similar to the gliders disclosed in the aforementioned patents. Accordingly, the seat portion 12 of the glider will normally rest on the gliding apparatus 54 at its mod-position. When a person sits on the glider and begins to rock back and forth thereon, the upper track members 56 and rollers or wheels 60 will move back and forth on the lower track members 58. The springs 96 will permit the glider to slide a short but approximately equal distance beyond each end of the lower track members 58 against the expanding force of the springs 96 which then contract to return the glider to its mid-position thereby effecting an oscillating action until the initial force is spent, at which time the glider resumes its normal centered rest position as shown in FIG. 1. The rollers or wheels 60 will move in a substantially straight path without undesirably side swaying or twisting.

Figure 3:
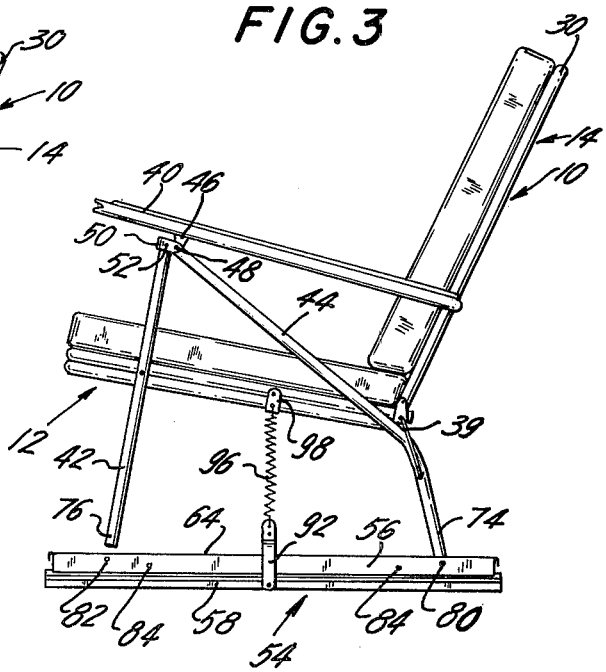
FIG. 3 is a fragmentary enlarged side elevational view of a portion of the glider shown in FIG. 1 in partially collapsed or disassembled form.

Unlike the glider constructions discloed in the aforementioned patents, the glider of the invention is preferably in the form of a collapsible glider which includes a collapsible frame as described above. The glider of the invention can be collapsed for purposes of storage without the necessity of removing any screws or bolts due to the particular design and construction of the side members 16 and the upper track member 56. Accordingly, if it is desired to collapse the glider of the invention, any cushions or pillows employed thereon would first be removed. Thereafter, the springs 96 must first be disengaged from the yokes 92. Before this can be done, tension on the springs must be relieved. In the glider constructions of the aforementioned patents, this is almost impossible to effect unless the entire frame assembly is disassembled. However, in the glider of the invention, tension on the springs 96 is relieved by simply lifting the trut members 42 from the openings 70 in the upper track members 56 while the upper track members 56 are rigidly held in place. As indicated previously, this can can be easily accomplished without the necessity of removal of any screws or bolts. FIGS. 3 illustrates a portion of the glider wherein one of the strut members 42 is removed from the opening 70 and displaced from the upper track member 56. The springs 96 are disengaged from the yokes 92 and thereafter the front portion of the seat portion 12 is grasped and simply pivoted toward the back seat portion. Inasmuch as the strut members 42 are connected to the sides of the tubular members 18, and are pivotally connected to the strut members 44 and the arm rest portions 40 by means of brackets 46 and 50 and associated pivot pins as described hereinbefore, the strut members 42 including the armrests 40 and the strut members 44 will also pivot toward the back seat portion 14. The upper track members 56 and lower track members 58 may then be pivoted about the pivot pins 80 until they assume a substantially vertical position. A side view of the glider of the invention in its collapsed position is shown in FIG. 6.

In order to fold the glider of the invention back into its normal working configuration, the seat portion 12 thereof is simply grasped and pivoted away from the back portion 14 until the seat and back portion assume the positions as shown in FIGS. 1 and 2. Thereafter, the springs 96 are made to engage the yokes 92 and the ends of the strut members 42 are inserted in the openings 70 of the upper track members. The glider of the invention is now ready for use as described hereinbefore.

We claim:

1. A glider designed for easy assembly, comprising, in combination, a frame having first and second ends and including a seat portion, a back rest portion and a pair of substantially vertically disposed side members mounted on each of said ends of said frame, a pair of elongated roller support members each including an upper track member and a lower track member, said upper track member being a substantially inverted U-shaped member which opens downwardly and includes a substantially horizontally disposed top wall and a pair of spaced side walls connected to said top wall, securing means for pivotally securing a first portion of each of said side members of said frame to said upper track members, support means connected to said upper track member for supporting a second portion of each of said side members in said upper track members, so that said second portions of said side members of said frame are adapted to be removed from said upper track members, to facilitate collapsing of said glider for storage purposes, and at least two rollers rotatably mounted to and between said side walls of said upper track member, said lower track member includes a track portion adapted to receive said rollers, and a floor engaging member, said frame further including biasing means extending between said side members of said frame and said lower track members for yieldingly urging said rollers in contact relation with said track portions thereof, said first and second portions of said side members of said frame comprise first and second downwardly extending strut members, and said top wall of said upper track members includes at least a first opening for receiving a lower end of said first strut member and a second opening for receiving a lower end of said second strut member, said securing means pivotally securing said lower end of said first strut member to said side walls of said upper track member, and said support means supporting, without securing, said one end of said second strut member.

2. The glider as defined in claim 1 wherein said securing means comprises pin means passing through openings in said one end of said strut members, connected to and between said side walls below said first opening in said top wall.

3. The glider as defined in claim 1 wherein said support means comprises pin means connected to and between said side walls below said second opening in said top wall.

4. The glider as defined in claim 1 wherein said top wall of each of said upper track members is substantially flat.

5. The glider as defined in claim 1 wherein said biasing means comprises a yoke extending over each of said roller support members, means for pivotally securing lower end portions of said yoke to each of said lower track members, at a point normally disposed between said at least two rollers when said upper track member is positioned in alignment with said lower track member, and a spring secured, at a lower end, to an upper end of said yoke, the upper end of said spring being secured to an end of said frame, whereby said glider is yieldingly urged to a substantially mid-point on said lower track members.

6. The glider as defined in claim 5 wherein said lower end of each of said yokes is pivotally secured to a mid-point of said floor engaging member of each of said lower track members and a bracket mounted to the mid-point of each end of said frame, the upper end of each of said springs being secured to each of said brackets.

7. The glider as defined in claim 1 wherein said rollers comprise a pair of spaced apart wheels vertically and rotatably mounted to and between said side walls and below said top wall of each of said upper track members.

8. The glider as defined in claim 7 wherein said track portion of each of said lower track members is of substantially U-shape in cross-section, and said side walls of each of said upper track members comprise substantially flat members connected at substantially right angles to said top walls, and said top wall of each of said upper track members is of substantially flat configuration.

9. The glider as defined in claim 1 wherein said frame is adapted to be collapsed for storage purposes and said back rest portion is collapsibly secured to said seat portion.

10. The glider as defined in claim 9 wherein each of said side members of said frame comprises an arm rest member, one end of which is pivotally secured to an end of said back rest portion and, an upper end of each of said first and second strut members being pivotally connected to each of said arm rest members, said first opening being near one end of said top wall, for receiving a lower end of said first strut member and said second opening being near the other end of said top wall, for receiving a lower end of said second strut member, said lower end of said first strut member including strut member support means disposed below said second opening, and said biasing means comprises a yoke extending over each of said roller support members, means for pivotally securing lower end portions of said yoke to said lower track member at a point normally disposed between said at least two rollers when said upper track member is positioned in alignment with said lower track member, and a spring secured, at a lower end, to an upper end of said yoke, the upper end of said spring being secured to an end of said frame, whereby said glider is yieldingly urged to a substantially mid-point on said lower track member, and each of said springs may be released from said yoke by removing each of said second strut members from said second openings in each of said top walls thereby releasing tension of said springs to faciliate disengagement of said lower end of each of said springs from each of said yokes and pivoting of said back rest portion and about said seat portion and pivoting of said arm rest members about said back rest portion.

11. A roller support member for use in a glider comprising, in combination, a lower track member and an upper track member adapted to be disposed over said lower track member, said upper track member including a substantially flat horizontally disposed top wall and a pair of spaced substantially flat side walls connected at approximately right angles to and extending downwardly from said top wall, said top walls including at least first and second spaced apart openings each adapted to receive strut members forming portions of side members of a glider, securing means mounted on said side walls below said first opening for pivotally securing one of said strut members to said upper track member, supporting means mounted on said side walls below said second opening for removably supporting a second of said strut members in said upper track member, at least two spaced apart roller means rotatably mounted to and between said side walls, said lower track member including a floor engaging member connected thereto, said lower track member adapted to receive said rollers, and a yoke extending over said upper track member and pivotally secured to said lower track member at a point normally disposed between said at least two rollers, said yoke further including means for securing a spring thereto.

12. A glider designed for easy assembly, comprising, in combination, a frame having first and second ends and including a seat portion, a back rest portion and a pair of substantially vertically disposed side members mounted on each of said ends of said frame, a pair of elongated roller support members each including an upper track member and a lower track member, said upper track member and a lower track member, said upper track member being a substantially inverted U-shaped member which opens downwardly and includes a substantially horizontally disposed top wall and a pair of spaced side walls connected to said top wall, said top wall of said upper track members includes at least a first opening for receiving a lower end of a first strut member of each of said side members and a second opening for receiving a lower end of a second strut member of each of said side members, securing means for piotally securing said first strut member of each of said side members of said frame to said side walls of said upper track members, support means connected to said side walls of said upper track member for supporting said second strut member of each of said side members, and at least two rollers rotatably mounted to and between said side walls of said upper track member, and said lower track member includes a track portion substantially U-shape in cross-section and adapted to receive said rollers, the side legs of said U-shaped track portion extending upwardly along the sides of said rollers and engaging said rollers to assist in preventing said rollers from being disengaged from said track portion, and a floor engaging member, said frame further including biasing means extending between said side members of said frame and said lower track members for yieldingly urging said rollers in contact relation with said track portions thereof.

* * * * *